US007571080B2

(12) United States Patent
Guo et al.

(10) Patent No.: US 7,571,080 B2
(45) **Date of Patent: *Aug. 4, 2009**

(54) APPARATUS FOR SLURRY AND OPERATION DESIGN IN CUTTINGS RE-INJECTION

(75) Inventors: Quanxin Guo, Sugar Land, TX (US); Thomas Geehan, Houston, TX (US)

(73) Assignee: M-I L.L.C., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/042,510

(22) Filed: Mar. 5, 2008

(65) Prior Publication Data

US 2008/0154554 A1 Jun. 26, 2008

Related U.S. Application Data

(63) Continuation of application No. 11/073,448, filed on Mar. 7, 2005, now Pat. No. 7,478,020.

(51) Int. Cl.
*G06G 7/48* (2006.01)

(52) U.S. Cl. ..... 703/2; 703/9; 703/10; 73/53.01; 702/9; 175/65

(58) Field of Classification Search ..... 703/2, 703/9, 10; 73/53.01; 702/9; 175/65
See application file for complete search history.

(56) References Cited

U.S. PATENT DOCUMENTS 4,595,422 A * 6/1986 Hill et al. ..... 134/19
4,942,929 A * 7/1990 Malachosky et al. ..... 175/66
5,109,933 A * 5/1992 Jackson ..... 175/66
5,129,468 A * 7/1992 Parmenter ..... 175/66
5,129,469 A * 7/1992 Jackson ..... 175/66
5,361,998 A * 11/1994 Sirevag et al. ..... 241/79.1
5,431,236 A * 7/1995 Warren ..... 175/66
2005/0203723 A1* 9/2005 Geehan et al. ..... 703/6
2006/0200329 A1* 9/2006 Guo et al. ..... 703/10

OTHER PUBLICATIONS

Shapiro et al., H.D. Microcomputer Technology for Drilling, Proceedings of the 1986 Workshop on Applied Computing, SAC '86, Oct. 1986, pp. 13-20.*

Young et al., L.C. High Performance Vector Processing in Reservoir Simulation, Proceedings of the 1991 ACM/IEEE Conference on Supercomputing, Aug. 1991, pp. 304-315.*

* cited by examiner

*Primary Examiner*—Russell Frejd
(74) *Attorney, Agent, or Firm*—Osha Liang LLP

(57) ABSTRACT

A system for simulating a wellbore used for cuttings re-injection, that includes functionality to obtain as input to the system at least one wellbore design parameter for the wellbore, at least one operating parameter for the cuttings re-injection, and a slurry design for a slurry to be injected into the wellbore, functionality to segment the wellbore into a plurality of elements, wherein each element includes a plurality of nodes, and functionality to perform a simulation at a current time interval. The functionality to perform the simulation includes functionality to update a solid accumulation at a bottom of the wellbore at the current time interval and functionality to perform for each of the plurality of nodes, until the wellbore reaches a steady-state condition for the current time interval, at least one calculation using the at least one wellbore design parameter, the at least one operating parameter, and/or the slurry design.

20 Claims, 6 Drawing Sheets

APPARATUS FOR SLURRY AND OPERATION DESIGN IN CUTTINGS RE-INJECTION

CROSS-REFERENCE TO RELATED APPLICATIONS

This application is a continuation of U.S. patent application Ser. No. 11/073,448 filed on Mar. 7, 2005, now U.S. Pat. Ser. No. 7,478,020, and entitled "APPARATUS FOR SLURRY AND OPERATION DESIGN IN CUTTINGS RE-INJECTION."

BACKGROUND

When drilling in earth formations, solid materials such as "cuttings" (i.e., pieces of a formation dislodged by the cutting action of teeth on a drill bit) are produced. One method of disposing of the oily-contaminated cuttings is to re-inject the cuttings into the formation using a cuttings re-injection (CRI) operation. The CRI operation typically involves the collection and transportation of cuttings from solid control equipment on a rig to a slurrification unit. The slurrification unit subsequently grinds the cuttings (as needed) into small particles in the presence of a fluid to make a slurry. The slurry is then transferred to a slurry holding tank for conditioning. The conditioning process affects the rheology of the slurry, yielding a "conditioned slurry." The conditioned slurry is pumped into a disposal wellbore, through a casing annulus or a tubular, into a deep formation (commonly referred to as the disposal formation) by creating fractures under high pressure. The conditioned slurry is often injected intermittently in batches into the disposal formation. The batch process typically involves injecting roughly the same volumes of conditioned slurry and then waiting for a period of time (e.g., shut-in time) after each injection. Each batch injection may last from a few hours to several days or even longer, depending upon the batch volume and the injection rate.

The batch processing (i.e., injecting conditioned slurry into the disposal formation and then waiting for a period of time after the injection) allows the fractures to close and dissipates, to a certain extent, the build-up of pressure in the disposal formation. However, the pressure in the disposal formation typically increases due to the presence of the injected solids (i.e., the solids present in the drill cuttings slurry), thereby promoting new fracture creation during subsequent batch injections. The new fractures are typically not aligned with the azimuths of previous existing fractures.

Release of waste into the environment must be avoided and waste containment must be assured to satisfy stringent governmental regulations. Important containment factors considered during the course of the operations include the following: the location of the injected waste and the mechanisms for storage; the capacity of an injection wellbore or annulus; whether injection should continue in the current zone or in a different zone; whether another disposal wellbore should be drilled; and the required operating parameters necessary for proper waste containment.

Modeling of CRI operations and prediction of disposed waste extent are required to address these containment factors and to ensure the safe and lawful containment of the disposed waste. Modeling and prediction of fracturing is also required to study CRI operation impact on future drilling, such as the required wellbore spacing, formation pressure increase, etc. A thorough understanding of the storage mechanisms in CRI operations as wellbore as solid settling and build-up in the wellbore are key for predicting the possible extent of the injected conditioned slurry and for predicting the disposal capacity of an injection wellbore.

One method of determining the storage mechanism is to model the fracturing. Fracturing simulations typically use a deterministic approach. More specifically, for a given set of inputs, there is only one possible result from the fracturing simulation. For example, modeling the formation may provide information about whether a given batch injection will open an existing fracture created from previous injections or start a new fracture. Whether a new fracture is created from a given batch injection and the location/orientation of the new fracture depends on the changes in the various local stresses, the initial in-situ stress condition, and the formation strength. One of the necessary conditions for creating a new fracture from a new batch injection is that the shut-in time between batches is long enough for the previous fractures to close. For example, for CRI into low permeability shale formations, a formation with a single fracture is favored if the shut-in time between batches is short.

The aforementioned fracturing simulation typically includes determining the required shut-in time for fracture closure. In addition, the fracturing simulation determines whether a subsequent batch injection may create a new fracture. The simulation analyses the current formation conditions to determine if the conditions favor creation of a new fracture over the reopening of an existing fracture. This situation can be determined from local stress and pore pressure changes from previous injections, and the formation characteristics. The location and orientation of the new fracture also depends on stress anisotropy. For example, if a strong stress anisotropy is present, then the fractures are closely spaced, however, if no stress anisotropy exits, the fractures are widespread. How these fractures are spaced and the changes in shape and extent during the injection history can be the primary factor that determines the disposal capacity of a disposal wellbore.

While the aforementioned fracturing simulations simulate the fracturing in the wellbore, the aforementioned fracturing simulations typically do not address questions about the solid transport within the wellbore (i.e., via the injected slurry fluid), slurry rheology requirements, pumping rate and shut-in time requirements to avoid settling of solids at the wellbore bottom, or the plugging of fractures.

SUMMARY

In general, in one aspect, the invention relates to a system for simulating a wellbore used for cuttings re-injection, comprising functionality to obtain as input to the system at least one wellbore design parameter for the wellbore, at least one operating parameter for the cuttings re-injection, and a slurry design for a slurry to be injected into the wellbore, functionality to segment the wellbore into a plurality of elements, wherein each element comprises a plurality of nodes, functionality to perform a simulation at a current time interval, wherein functionality to perform the simulation comprises: functionality to update a solid accumulation at a bottom of the wellbore at the current time interval, functionality to perform for each of the plurality of nodes, until the wellbore reaches a steady-state condition for the current time interval, the following using the at least one wellbore design parameter, the at least one operating parameter, and the slurry design: calculating a sliding bed velocity, calculating a suspension cross-section area using the sliding bed velocity, calculating an average suspension velocity using the suspension cross-section area, calculating a solid particle velocity using the average suspension velocity, and calculating a solid volume concentration in suspension using the solid particle velocity.

In general, in one aspect, the invention relates to a computer system for simulating cuttings re-injection in a wellbore, comprising a processor, a memory, a storage device, and software instructions stored in the memory for enabling the computer system under control of the processor, to: define a mass balance equation for a solids bed, define a mass balance equation for a suspension solids, segment the wellbore into a plurality of elements, wherein each element comprising a plurality of nodes, segment a simulation into a plurality of time intervals, and for each the plurality of time intervals: simulate cuttings re-injection to solve the mass balance equation for the solids bed and the mass balance equation for a suspension solids for each of the plurality of nodes.

In general, in one aspect, the invention relates to a computer system for simulating cuttings re-injection in a wellbore, comprising: a processor, a memory, a storage device, and software instructions stored in the memory for enabling the computer system under control of the processor, to: input at least one wellbore design parameter for the wellbore, input at least one operating parameter for the cuttings re-injection, input a slurry design for a slurry to be injected into the wellbore; segment the wellbore into a plurality of elements, wherein each element comprising a plurality of nodes, perform a simulation at a current time interval, wherein performing the simulation comprises: update a solid accumulation at a bottom of the wellbore at the current time interval, perform for each of the plurality of nodes, until the wellbore reaches a steady-state condition for the current time interval, the following using the at least one wellbore design parameter, the at least one operating parameter, and the slurry design: calculate a sliding bed velocity, calculate a suspension cross-section area using the sliding bed velocity, calculate an average suspension velocity using the suspension cross-section area, calculate a solid particle velocity using the average suspension velocity, and calculate a solid volume concentration in suspension using the solid particle velocity.

Other aspects of the invention will be apparent from the following description and the appended claims.

DETAILED DESCRIPTION

Figure 1:
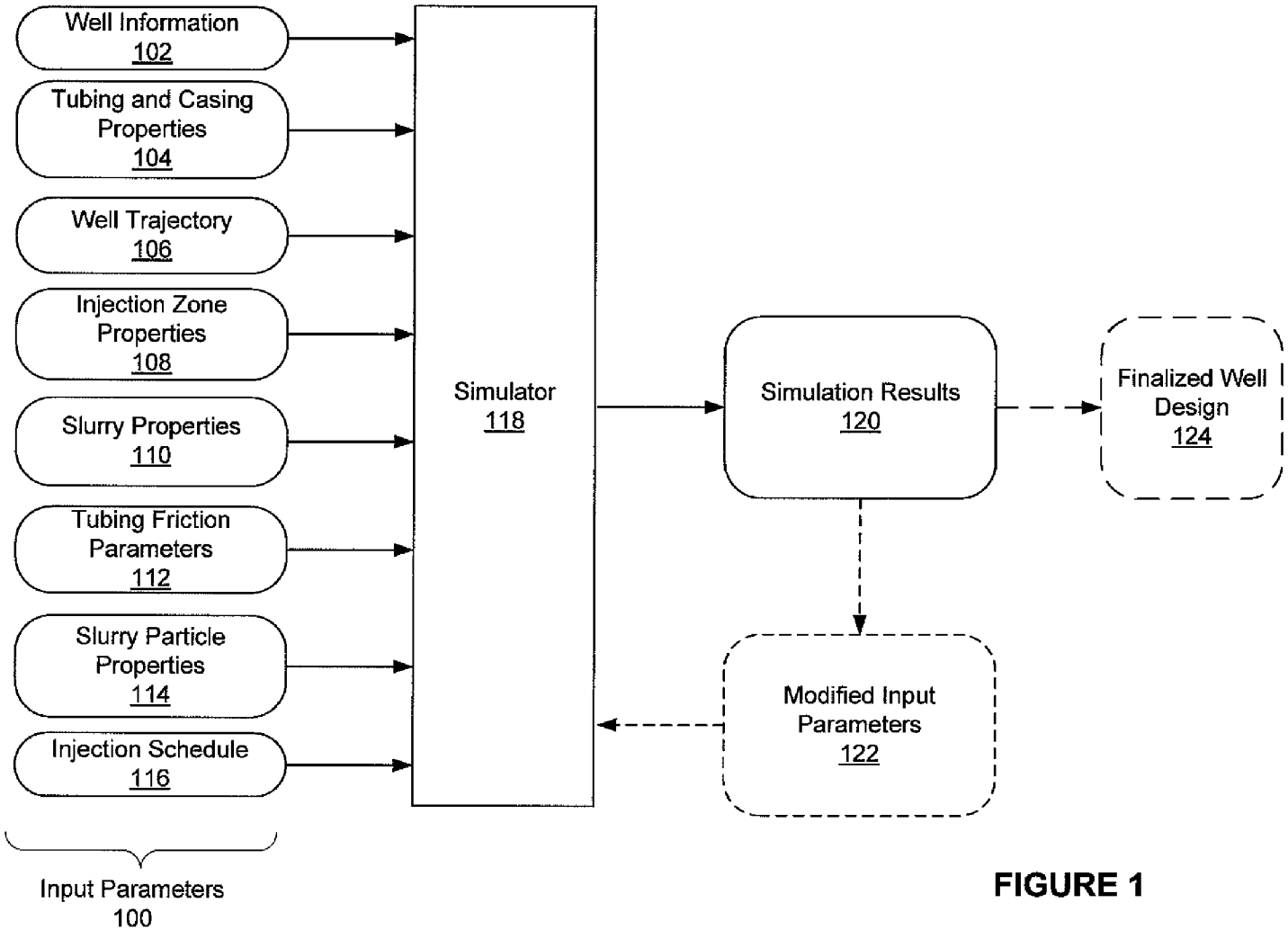
FIG. 1 shows a system in accordance with one embodiment of the system.

Specific embodiments of the invention will now be described in detail with reference to the accompanying figures. Like elements in the various figures are denoted by like reference numerals for consistency.

In the following detailed description of the invention, numerous specific details are set forth in order to provide a more thorough understanding of the invention. However, it will be apparent to one of ordinary skill in the art that the invention may be practiced without these specific details. In other instances, wellbore-known features have not been described in detail to avoid obscuring the invention.

In general, embodiments of the invention provide a method and system for simulating solids transport along a wellbore in CRI operations. In one embodiment of the invention, the results of simulating CRI in the wellbore provide operators with a way to optimize operating parameters (e.g., shut-in time, pumping rate, etc.), wellbore design (i.e., tubing to use, deviation angle, etc.), and slurry design (i.e., particle size, fluids used to make slurry, etc.). With respect to the simulating CRI, embodiments of the invention provide a method and system for simulating solid settling and transport mechanisms, bed sliding mechanisms, perforation plugging mechanisms, mechanisms governing solid settling within a fracture, etc. Further, embodiments of the invention enable a user to model accumulation of solids in vertical wellbore and deviated wells.

FIG. 1 shows a system in accordance with one embodiment of the system. The system shown in FIG. 1 includes a simulator (118) which takes a number of input parameters (100) and produces simulation results (120). If the simulation results (120) (described below) do not satisfy one or more criteria (described below), one or more of the input parameters (100) may be modified to obtain modified input parameters (122). The modified input parameters (122) along with the unmodified input parameters (100) may be re-input into the simulator (118) to generate additional simulation results (120). Alternatively, if the simulation results (120) satisfy one or more criteria, then the simulation results along with various input parameters (100) may be used to generate a final wellbore design (124). In one embodiment of the invention, the final wellbore design (124) includes operations parameters, slurry design, and wellbore design parameters.

In one embodiment of the invention, the simulation result (120) may include, but is not limited to, information corresponding to the rate at which solids settle in the wellbore, the solid distribution (i.e., the cross-sectional area of the wellbore that is blocked by solids) within the wellbore, etc. An example of simulation results for a wellbore is shown below in FIG. 4B-4D. In one embodiment of the invention, the criterion used to determine whether to run additional simulations may include, but is not limited to, the rate at which solids are settling in the wellbore, the maximum shut-in time between injections, etc.

In one embodiment of the invention, the simulator (118) takes as input three general types of information: (i) slurry design parameters, (ii) wellbore design parameters, and (iii) operational parameters. In one embodiment of the invention, the slurry design parameters may include, but are not limited to, information about particle size (i.e., size of cuttings in the slurry), the specific gravity of the particles, carrier fluid viscosity, etc. In one embodiment of the invention, the wellbore design parameters may include, but are not limited to, information corresponding to wellbore depth, wellbore diameter, information corresponding to the injection zone, information corresponding to the perforation zone, etc. In one embodiment of the invention, the operational parameters may include, but are not limited to, information corresponding to shut-in time, information corresponding to pump rate and duration of pumping, etc.

In one embodiment of the invention, the information corresponding to the aforementioned general types of input parameters are divided into eight sets of input parameters: (i) Wellbore Information (102); (ii) Tubing and Casing Properties (104); (iii) Wellbore Trajectory (106); (iv) Injection Zone Properties (108); (v) Slurry Properties (110); (vi) Tubing Friction Parameters (112); (vii) Slurry Particle Properties (114); and (viii) Injection Schedule (116). In one embodiment of the invention, input parameters within Wellbore Information (102), Tubing and Casing Properties (104), Wellbore Trajectory (106), Injection Zone Properties (108) and Tubing Friction Parameters (112) correspond to wellbore design parameters. Further, in one embodiment of the invention, input parameters within Slurry Properties (110) and Slurry Particles Properties (114) correspond to slurry design parameters. Finally, in one embodiment of the invention, input parameters within Injection Schedule (116) correspond to operational parameters. Each of the aforementioned sets of input parameters is described below.

In one embodiment of the invention, Wellbore Information (102) may include, but is not limited to, the following input parameters: input parameters indicating whether the slurry is being injected down tubing or down a tubing/casing annulus; input parameters corresponding to the depth of the wellbore (typically, the same depth as the casing depth, but could be greater than casing depth, in which case the wellbore is assumed open hole below the casing depth); input parameters corresponding to the diameter of the wellbore for wellbore depths greater than the casing depth (typically greater than the casing outer diameter); input parameters corresponding to the bottom hole temperature; and input parameters corresponding to the surface temperature.

In one embodiment of the invention, Tubing and Casing Properties (104) may include, but is not limited to, the following input parameters: input parameters corresponding to the number of tubing sections, input parameters corresponding to the measured depth of the end of each the tubing section (note: each tubing section end depth must be greater than the previous tubing section end depth), input parameters corresponding to the outside diameter of each tubing section; input parameters corresponding the inside diameter of each tubing section; input parameters corresponding to the number of casing sections, input parameters corresponding to the measured depth of the end of each casing section (note that each casing section end depth must be greater than the previous casing section end depth); input parameters corresponding to the outside diameter of each casing section; and input parameters corresponding to the inside diameter of each casing section (note that the inside diameter of each casing section must be greater than the tubing outside diameter).

In one embodiment of the invention, Wellbore Trajectory (106) may include, but is not limited to, the following input parameters: input parameters corresponding to the number of survey points; input parameters corresponding to the measured depth of each survey point; and input parameters corresponding to the true vertical depth of each survey point.

In one embodiment of the invention, Injection Zone Properties (108) may include, but is not limited to, the following input parameters: input parameters corresponding to the measure depth of the top of the perforated interval; input parameters corresponding to the measured depth of the bottom of the perforated interval; input parameters corresponding to the diameter of the perforations; input parameters corresponding to perforation shot density (typically expressed in number of holes per meter); input parameters corresponding to the vertical depth of the top of the injection zone; input parameters corresponding to the vertical depth of the bottom of the injection zone (note that the zone bottom must be greater than the corresponding vertical depth of the top perforation); input parameters corresponding to the Young's modulus of the formation rock in which the wellbore is located (or to be located); input parameters corresponding to the Poisson's ratio of the formation rock; input parameters corresponding to the minimum in-situ stress of the formation; and input parameters corresponding to the minimum fluid leak-off coefficient.

In one embodiment of the invention, the input parameters within Injection Zone Properties (108) may be subject to one or more of the following assumptions/constraints: (i) A single perforated interval is assumed, if there is more than one interval in the wellbore, then the individual perforated intervals are combined and treated as single perforated interval; (ii) If the injection is into an openhole section, then the depth of the perforated top and the depth of the perforated bottom may be set to the same depth as the casing end depth; and (iii) The fracture created by the injection is assumed to have a constant height equal to the depth of the zone bottom minus the depth of the zone top.

In one embodiment of the invention, Slurry Properties (110) includes data for fluids (e.g., carrier fluids, etc.) used in the simulation. In one embodiment of the invention, the fluids used in the simulation are described as Herschel-Buckley (i.e., a yield-power law) fluids and are defined using a power-law index n', a consistency index k' and a yield point. Further, if the yield point for a given fluid equals to zero, the fluid is then simulated to behave as power-law fluid (as opposed to behaving as a Hirschel-Buckley fluid). In addition, a zero-shear viscosity and a base fluid specific gravity may be defined for each fluid. The Slurry Properties (110) also include input parameters corresponding to the solids (i.e., cuttings) specific gravity and the slurry specific gravity. Those skilled in the art will appreciate that the slurry specific gravity, solids specific gravity, and base fluid specific gravity used for a particular slurry may be used to calculated solids concentration in the slurry.

In one embodiment of the invention, input parameters within Tubing Friction Parameters (112) specify how the tubing friction is calculated for each of the fluids used in the simulation. In one embodiment of the invention, the tubing friction for a given fluid may be defined using one or two methods. In the first method, the tubing friction is calculated using a Dodge-Metzner correlation. In the second method, the tubing friction is calculated based on the three rates (described below) and the corresponding pressure gradients. The three rates include a low rate, a pivot rate, and a high rate. The low rate corresponds to a rate within a laminar flow regime, the pivot rate corresponds to a rate within the transition from the laminar flow regime to a turbulent flow regime, and the high rate corresponds to the rate in the turbulent flow regime. In one embodiment of the invention, the corresponding pressure gradient is interpolated (or extrapolated) from these three points using a logarithmic scale. Those skilled in the art will appreciate that different types of tubing will have different values for the three aforementioned rates and corresponding pressure gradients. In one embodiment of the invention, values for the three rates and the corresponding pressure gradients are empirical values obtained from the actual pressure measurements.

In one embodiment of the invention, Slurry Particle Properties (114) may include, but are not limited to, the following input parameters: input parameters corresponding to the number of different particle sizes; input parameters related to the particle diameter for each of the different particle sizes, input parameters related to the percent of solids below each of the different particle sizes; input parameters related to the particle size below which the solids are considered non-settling, etc.

In one embodiment of the invention, Injection Schedule (116) may include, but is not limited to, the following input parameters: the number of stages (including injection stages and shut-in stages); the duration of each stage; the pump rate of cuttings for each stage (note that the pump rate is set to zero if the stage corresponds to a shut-in stage), etc.

As described above, the simulator (118), using at least some of the aforementioned input parameters (100), simulates CRI within the wellbore and generates simulation results (120). In one embodiment of the invention, the simulator (118) performs the simulation by first segmenting the wellbore into small (though not necessarily uniform) elements (bounded by two nodes) and the pumping schedule is divided into small time steps (i.e., $\Delta t$). The simulator (118) then uses a finite difference method to simulate solids suspension and transport along the wellbore in CRI operations. In particular, at each current time step (i.e., at $t+\Delta t$), values of field variables defined at the nodes bounding each of the elements that make-up the wellbore are computed based on the governing equations (described below) using the corresponding values of the field variables in the previous time step (i.e., at t).

Figure 2:
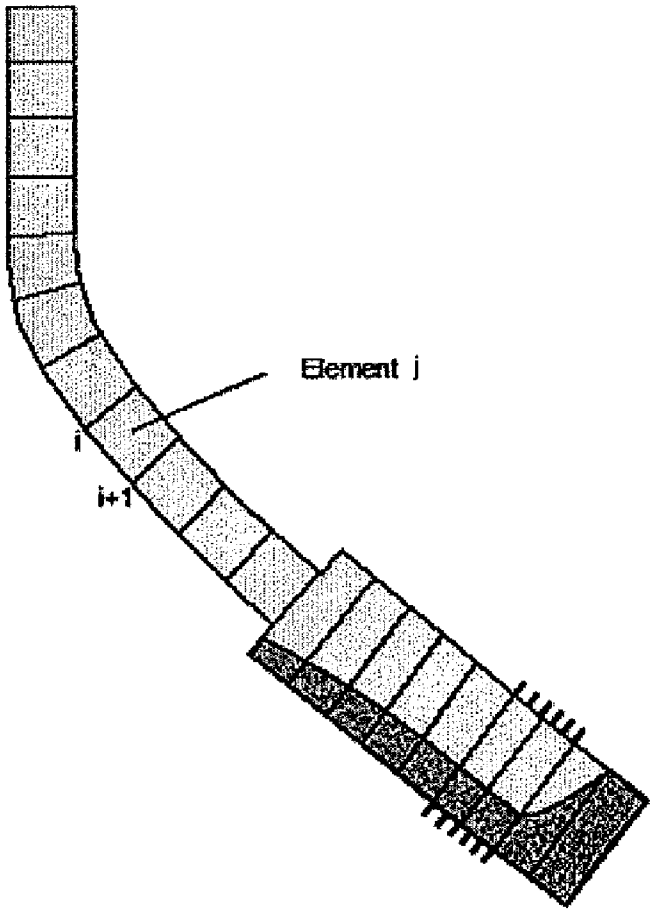
FIG. 2 shows a wellbore segmented into a number of elements in accordance with one embodiment of the invention.

FIG. 2 shows a wellbore segmented into a number of elements in accordance with one embodiment of the invention. As shown in FIG. 2, the wellbore is segmented into a number of elements. Further, each element (j) is bounded by a node (i) and a node (i+1). In one embodiment of the invention, the following field variables are defined and/or calculated for each node: depth (x), deviation angle ($\theta$), fluid index, fluid pressure (p), fluid temperature (T), average suspension velocity ($U_s$), solid particle velocity in the suspension ($U_p$), fluid velocity ($U_f$), solid volume concentration in the suspension ($c_s$), suspension cross-sectional area ($A_s$), bed cross-sectional area ($A_B$), bed sliding velocity ($U_B$), and bed height (h). Those skilled in the art will appreciate that additional field variables may be defined at each node. In one embodiment of the invention, the following field variables may be defined for each element: annulus inside diameter (AID), annulus outside diameter (AOD), and cross-sectional area of the element (A). Those skilled in the art will appreciate that additional field variables may be defined for each element.

As described above, the simulator (118) uses a finite difference method to simulate CRI in the wellbore. Those skilled in the art will appreciate that the finite difference method is a simple and efficient method for solving ordinary differential equations in regions with simple boundaries. With respect to the present invention, the finite difference method is applied to two mass balance equations which are expressed as ordinary differential equations. The mass balance equations which are expressed as ordinary differential equations are a mass balance equation for the solids bed (i.e., the settled solids) and a mass balance equation for the suspension (i.e., solids suspended in the liquid). Each of the aforementioned mass balance equations is defined below:

In one embodiment of the invention, the following equation (Equation 1) corresponds to the mass balance equation for the solids bed:

$$\frac{\partial A_B}{\partial t} = -\frac{\partial}{\partial x}(A_B U_B) + a_d / c_B \tag{1}$$

where $c_B$ is the solids concentration in the bed and $a_d$ is the solids deposition rate from suspension onto the bed. If $U_S$ is less than the critical transport velocity (CTV) (i.e., the velocity of the carrier fluid below which suspended solids settle out of the carrier fluid), then $a_d$ is defined using the following equation (Equation 2):

$$a_d = S_i v_p c_s \sin\theta \tag{2}$$

where $S_i$ is the length of the bed/suspension interface and $v_p$ is the settling velocity of the sediment. If $U_S$ is equal to CTV, then $a_d$ equals zero. Finally, if $U_S$ is greater than CTV, then $a_d$ is defined using the following equation (Equation 3):

$$a_d \Delta t = (A_{U_s = crv} - A_B) c_B \tag{3}$$

In one embodiment of the invention, the following equation (Equation 4) corresponds to the mass balance equation for the suspension:

$$\frac{\partial}{\partial t}(A_s c_s) = -\frac{\partial}{\partial x}(A_s c_s U_p) - a_d - q_f c_s \eta \tag{4}$$

where $\eta$ is the perforation transport efficiency and $q_f$ is the flow rate into the perforations per unit distance along the wellbore. Values for $\eta$ may determined using numerical simulation data studies that are well known to one of skill in the art. In one embodiment of the invention, the value for $q_f$ is defined using the following equation (i.e., Equation 5):

$$q_f = \begin{cases} 0 & x \le x_{pt} \\ \dfrac{Q}{x_{pb} - x_{pt}} & x_{pt} < x < x_{pb} \\ 0 & x > x_{pb} \end{cases} \tag{5}$$

where Q is the pump rate and $x_{pt}$ and $x_{pb}$ correspond to the top and bottom depths of the open perforated interval, respectively.

Applying the finite difference method to equations (1) and (4) results in the following equations:

$$A_{B,i+1}^{t+\Delta t}\left(1 + \frac{\Delta t}{\Delta x} U_{B,i+1}^{t+\Delta t}\right) = A_{B,i+1}^{t} + \frac{\Delta t}{\Delta x} A_{B,i}^{t+\Delta t} U_{B,i}^{t+\Delta t} + \Delta t\ a_d / c_B \tag{6}$$

$$A_{s,i+1}^{t+\Delta t}\left(1 + \frac{\Delta t}{\Delta x} U_{p,i+1}^{t+\Delta t}\right) c_{s,i+1}^{t+\Delta t} = A_{s,i+1}^{t} c_{s,i+1}^{t} + \frac{\Delta t}{\Delta x} A_{s,i}^{t+\Delta t} c_{s,i}^{t+\Delta t} U_{p,i}^{t+\Delta t} - \Delta t(a_d + q_f c_s \eta) \tag{7}$$

The aforementioned mass balance equations (in finite form, i.e., Equations 6 and 7), along with the following four equations fully describe the wellbore system. The first of the four equations (i.e., Equation 8) corresponds to the mass balance equation for the solid-fluid system (assuming that the carrier fluid is incompressible). The second of the four equations (i.e., Equation 9) relates the average suspension velocity to the solid and fluid velocity. The third of the four equations (i.e., Equation 10) describes the slip velocity between the solid particles and the carrier fluid. The final equation (i.e., Equation 11) describes the bed sliding velocity. The equations are as follows:

$$A_s U_s + A_B U_B = \begin{cases} Q & x \le x_{pt} \\ Q\left(1 - \dfrac{x - x_{pt}}{x_{pb} - x_{pt}}\right) & x_{pi} < x < x_{pb} \\ 0 & x > x_{pb} \end{cases} \tag{8}$$

-continued $$U_s = c_s U_p + (1 - c_s) U_f \tag{9}$$

$$U_p - U_f = v_p \cos\theta \tag{10}$$

$$\overline{U}_B = U_{B0} + \frac{1}{80\mu}\left[\tau_i \frac{h}{2} + g(\rho_B - \rho_f)\cos\theta \frac{h^2}{3}\right] \tag{11}$$

where $U_{B0}$ is the velocity at the bottom of the solids bed (equations for determining $U_{B0}$ are described below), $\mu$ is the fluid viscosity, and $\tau i$ is the shear stress exerted by the fluid at the suspension/bed interface. In one embodiment of the invention, the following equation (i.e., Equation 12) is used to calculate $\tau_i$:

$$\tau_i = \frac{1}{2} f_i \rho_s U_s^2 \tag{12}$$

where $f_i$ is the friction factor for the suspension/bed interface and $\rho_S$ is the density of the suspension.

Figure 3:
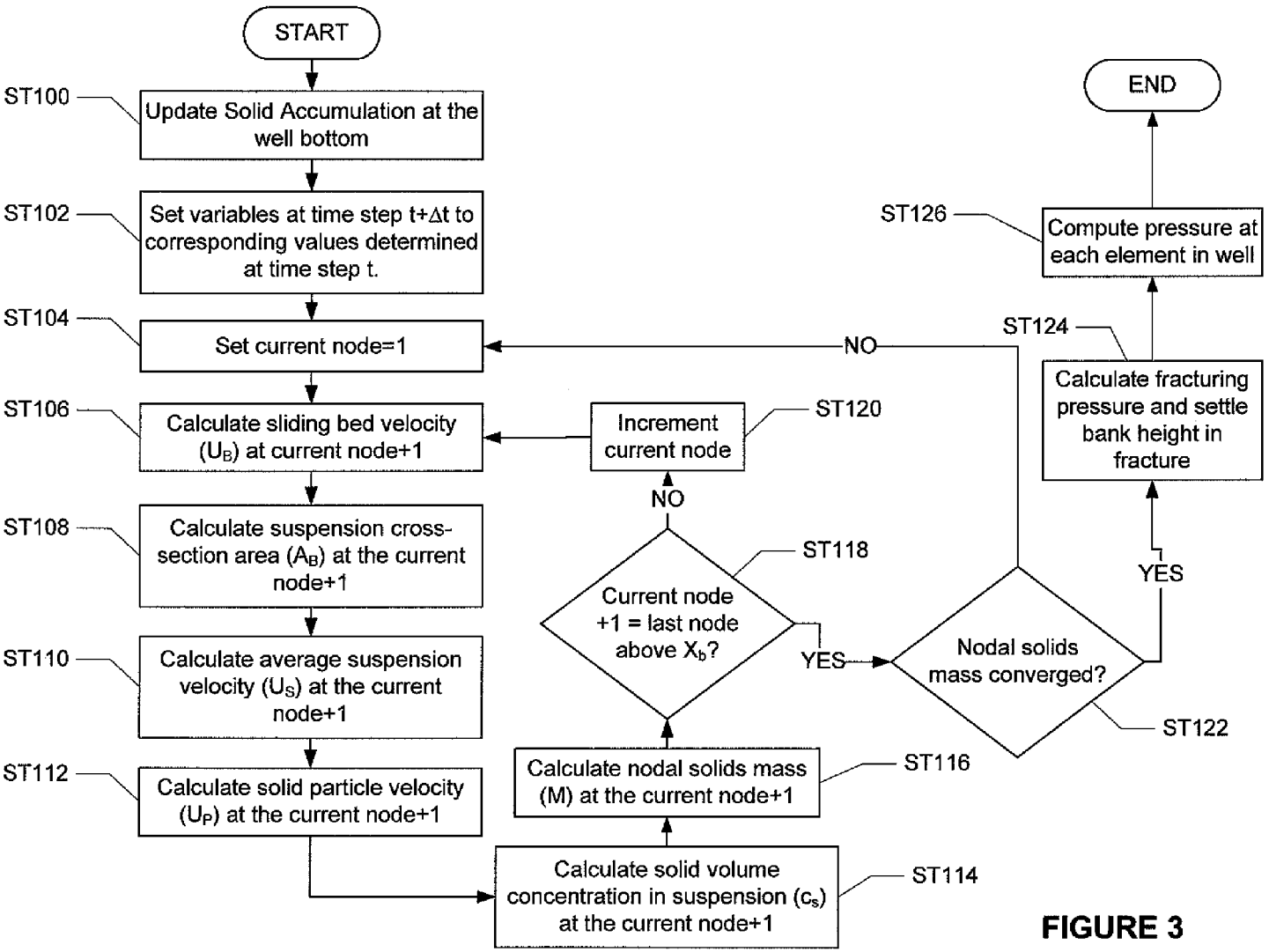
FIG. 3 shows a flow chart in accordance with one embodiment of the invention.

Using equations (6)-(11) the simulator (118) simulates CRI in a wellbore. As discussed above, the simulator (118) performs calculations at each time step (i.e., every time t is incremented by $\Delta t$) for the duration of the simulation. FIG. 3 shows a method of using equations (6)-(11) at a given time step (i.e., $t+\Delta t$) in the simulation. Those skilled in the art will appreciate that the method described in FIG. 3 will be repeated at each time step in the simulation.

Initially, once the simulation enters a current time step (i.e., $t+\Delta t$), the accumulations of solids at the wellbore bottom is updated (ST100). More specifically, in one embodiment of the invention, ST100 includes first determining whether the perforation tunnel velocity is greater than 6.5 ft/sec and an effective concentration (i.e., total solids volume/[total solids volume plus fluid volume]) is less than 0.4. If both the aforementioned conditions are satisfied, then solids will not accumulate at the wellbore bottom; rather, the solids will flow into the perforations and subsequently settle. Those skilled in the art will appreciate that the present invention is not limited to the aforementioned values for perforation tunnel velocity and effective concentration.

Continuing with the discussion of FIG. 3 ST100, if both the aforementioned conditions are not satisfied, then solids will accumulate at the bottom of wellbore. In this scenario, the solid accumulation at the wellbore bottom is calculated by determining the amount of solid deposited on the wellbore bottom due to solid settling (i.e., Equation 13) and by determining the solids deposited on the wellbore bottom due to bed sliding (i.e., Equation 14). The results of the aforementioned calculations are combined to determine the new/updated depth of the fill top (i.e., the depth of the solids accumulation in the wellbore with respect to the surface) using Equation (15). The equations are as follows:

$$\Delta V_1 = A_{s,n}{}^t c_{s,n}{}^t v_p \Delta t / c_B \tag{13}$$

$$\Delta V_2 = A_{B,n}{}^t U_{B,n}{}^t \Delta t \tag{14}$$

$$x_b^{t+\Delta t} = x_b^t - \frac{\Delta V_1 + \Delta V_2}{A} \tag{15}$$

where $x_b^{t+\Delta T}$ is the depth of the fill top at the current time step and $x_b^t$ is the depth of the fill top at the previous time step.

After the solid accumulation at the wellbore bottom is updated, the values for the field variables at each of the nodes at the current time step (i.e. $t+\Delta t$) are initially set to the corresponding values determined in the previous time step (i.e., t) (ST102). At this stage, the simulator (118) is ready to simulate CRI in the wellbore. In order to simulate CRI in the wellbore, the simulator (118) sets the current node to 1 (i.e., i=1, where the node identified by i=1 is the node at the surface) (ST104). The simulator (118) then proceeds to perform steps 106-118 for the current node+1.

For the current node+1 (i.e., node at i+1), the simulator (118) first calculates the sliding bed velocity ($U_{B,i+1}^{t+\Delta t}$) at the current time step (ST106). In one embodiment of the invention, if $F_B/F_N < \mu_{fr}$, the solids bed is stationary then $U_{B,i+1}^{t+\Delta t}$ is zero. In one embodiment of the invention, $F_B$ is the total shear force at the wellbore wall including the effect of fluid shear stress and solids grain contact fraction and is calculated using the following equation (Equation 16):

$$F_B = F_B' + S_B \tau_B = \frac{A_B}{A_s} S_s \tau_s + \left(1 + \frac{A_B}{A_s}\right) S_i \tau_i + g(\rho_B - \rho_s) A_B \cos\theta \tag{16}$$

where $S_s$ is the suspension length in a cross-section of the node, $\tau_s$ is the shear stress exerted by the fluid on wellbore wall in the suspension and is calculated using the following equation (Equation 17):

$$\tau_s = \frac{1}{2} f_s \rho_s U_s^2 \tag{17}$$

In one embodiment of the invention, $F_N$ is the normal friction force and is calculated using the following equation (Equation 18):

$$F_N = g(\rho_B - \rho_S) A_B \sin\theta \tag{18}$$

where $\rho_B$ is the density of the solids bed. Finally, in one embodiment of the invention, $\mu_{fr}$ corresponds to the contact friction coefficient. Those skilled in the art will appreciate that the value of $\mu_{fr}$ may be empirically determined from the fluid system to be simulated using a flow loop test apparatus. Further it will be appreciated that the value of $\mu_{fr}$ may require optimization that depends upon the fluid system and specific wellbore environment. The selection of a specific value does not limit the scope of the invention.

Continuing with the discussion of FIG. 3 ST106, if $\mu_{fr} < F_B/F_N <$ a certain value (which may be determined empirically), then the solids bed is assumed to move as a rigid body with $U_{B,i+1}^{t+\Delta t}$ determined using the following equation (Equation 19):

$$\tau_B = \alpha \frac{\mu U_B}{d_p} \tag{19}$$

where $\tau_B$ is the shear stress exerted by the fluid at the bed/wellbore wall interface and, $\alpha$ is a constant. Those skilled in the art will appreciate that the value of $\alpha$ may depend upon the specific wellbore conditions and may be empirically determined using a flow loop test apparatus. Further it will be appreciated that the value of $\mu_{fr}$ may require optimization that depends upon the fluid system and specific wellbore environment that is being simulated. The selection of a specific value does not limit the scope of the invention.

Finally, if $F_B/F_N$ exceeds a threshold value, then the solids bed is assumed to be undergoing shear deformation and $U_{B,i+1}^{t+\Delta t}$ is determined using Equation 12. Those skilled in the art will appreciate that the value of $F_B/F_N$ will depend upon the specific implementation and may be empirically determined using a flow loop test apparatus. Further it will be appreciated that the value of $F_B/F_N$ may require optimization that depends upon the fluid system and specific wellbore environment that is being simulated. The selection of a specific value does not limit the scope of the invention. In one embodiment of the invention, the value of h (i.e., bed height at the current node+1) is determined by solving the following equation (i.e., Equation 20) for h:

$$U_{B0} + \frac{1}{80\mu}\left[\tau_i h + g(\rho_B - \rho_f)\cos\theta\frac{h^2}{2}\right] = CTV + U_s \tag{20}$$

In one embodiment of the invention, CTV is the critical transport velocity and is denoted as $V_c$ in the following equations. In one embodiment of the invention, CTV is calculated using the following equation (i.e., Equation 21):

$$V_c = \frac{V_{max}}{1 + e^{-40c}} \tag{21}$$

where $V_{max}$ equals an optimized value of $V_{c0}$. If the liquid is flowing in a laminar flow regime determined, for example as determined by using a Reynolds number, then $V_{c0}$ (denoted as $V_c$ in the following equation) is determined using the following equation (i.e., Equation 22):

$$V_c = 0.115[g(\rho_p/\rho_f - 1)\sin\theta]^{0.67}(\mu/\rho_f)^{-0.33}D \tag{22}$$

If the liquid is flowing in a turbulent flow regime determined, for example as determined by using a Reynolds number, then $V_{c0}$ (denoted as $V_c$ in the following equation) is determined using the following equation (i.e., Equation 23):

$$V_c = C\left[g\left(\frac{\rho_P}{\rho_f} - 1\right)D\sin\theta\right]^{0.5} \tag{23}$$

where $C=0.4f^{0.25}$. In one embodiment of the invention, f is determined using the appropriate Moody friction factor equation(s) that take into account the pipe roughness and the Reynolds's number.

Continuing with the discussion of FIG. 3, once $U_{B,i+1}^{t+\Delta t}$ has been calculated, the simulator (118) proceeds to calculate the suspension cross-section area for the current node+1 (i.e., $A_{B,i+1}^{t+\Delta t}$) (ST108). In one embodiment of the invention, the simulator (118) uses Equation (6) to calculate $A_{B,i+1}^{t+\Delta t}$. Those skilled in the art will appreciate that the value obtained for $U_{B,i+1}^{t+\Delta t}$ in ST106 is used to calculated $A_{B,i+1}^{t+\Delta t}$.

The simulator (118) subsequently calculates the suspension velocity for the current node+1 (i.e., $U_{S,i+1}^{t+\Delta t}$) (ST110). In one embodiment of the invention, the following equation (i.e., Equation 24) is used to calculate $U_{S,i+1}^{t+\Delta t}$:

$$U_{s,i+1}^{t+\Delta t} = (q_{i+1} - A_{B,i+1}^{t+\Delta t}U_{B,i+1}^{t+\Delta t})/A_{s,i+1}^{t+\Delta t} \tag{24}$$

where $q_{i+1}$ is determined using the right-hand side of equation (8).

The simulator (118) then uses the value of $U_{S,i+1}^{t+\Delta t}$ calculated in ST110 to calculate the solid particle velocity at the current node+1 (i.e., $U_{P,i+1}^{t+\Delta t}$) (ST112). In one embodiment of the invention, the following equation (i.e., Equation 25) is used to calculate $U_{P,i+1}^{t+\Delta t}$:

$$U_{p,i+1}^{t+\Delta t} = U_{s,i+1}^{t+\Delta t} + (1 - c_{s,i+1}^{t+\Delta t})v_\rho \cos\theta_{i+1} \tag{25}$$

Though not shown in FIG. 3, once the value of $U_{P,i+1}^{t+\Delta t}$ is calculated, the simulator (118) may use equation (10) to calculate the fluid velocity at the current node+1 (i.e., $U_{F,i+1}^{t+\Delta t}$). The simulator (118) subsequently calculates the solid volume concentration in suspension for the current node+1 (i.e., $c_{s,i+1}^{t+\Delta t}$) using the value of $U_{P,i+1}^{t+\Delta t}$ calculated in ST112 and equation (7). The simulator (118) then calculates the nodal solids mass at the current node+1 ($M_{i+1}$) using the following equation (i.e., Equation 26):

$$M_{i+1} = A_{B,i+1}^{t+\Delta t}c_B + A_{s,i+1}^{t+\Delta t}c_{s,i+1}^{t+\Delta t} \tag{26}$$

Once the simulator (118) has calculated $M_{i+1}$, the simulator (118) determines whether the current node+1 equals the last node above the fill top (i.e., $x_b$) (ST118). Those skilled in the art will appreciate that all elements below the fill top will be full of settled solids, and thus, the aforementioned calculations do not need to performed on them. If the current node+1 does not equal the last node above the fill top (i.e., $x_b$), then the simulator (118) increments the current node (ST120) and then proceeds to repeat ST106-ST118. Thus, the simulator (118) performs ST106-ST118 for each node above the fill top. Once the simulator has performed ST106-ST118 for each node above the fill top, then the current node+1 will equal the last node above the fill top. At this stage, the simulator (118) determines whether the nodal solids mass for each of the nodes in the wellbore have converged (i.e., nodal solids mass for each node has reached a steady-state) (ST122).

If the nodal solids mass for each of the nodes in the wellbore has not converged, then the simulator proceeds to ST104. As a results of proceeding to ST104, the simulator (118) performs ST106-ST116 again (i.e., performs a second iteration) for each node in the wellbore using the values of the field variables calculated the pervious time the simulator performed ST106-ST116 for the node at the current time step (i.e., t+Δt). Once ST106-ST108 have been performed a second time, nodal solids mass for each node calculated during the first iteration are compared with the values of nodal solid masses obtained when ST106-ST116 are performed a during the second iteration. If the difference between the nodal solids mass obtained during the first iteration as compared with the second iteration for all the nodes is within a given range (e.g., 0, <1, etc.), then the nodal solids mass have converged. However, if the nodal solids mass has not converged, then additional iterations are performed (i.e., ST106-ST118 are repeated for each of the nodes) until the nodal solids mass converges.

If the nodal solids mass for each of the nodes in the wellbore has converged, then the simulator proceeds to calculate compute the fracturing pressure in the wellbore and the settled bank height in the fracture (ST124). In one embodiment of the invention, the fracture pressure in the wellbore is determined by an iterative hydraulic fracture model. Such models should be well known to one of skill in the art and the selection of a particular model does not have a substantial impact on the present invention.

In one embodiment of the invention, the settled bank height build-up in the fracture is calculated using the following equation (i.e., Equation 37):

$$H_B = c/c_B v_p t_p \quad (27)$$

where $H_B$ is the solids bank height in the fracture. Once the fracturing pressure in the wellbore and the settled bank height in the fracture have been calculated, the simulator (118) proceeds to calculate the pressure for each element in the wellbore (ST126). In one embodiment of the invention, the calculation of pressure for each element in the wellbore takes into account friction associated with each element.

Those skilled in the art will appreciate that while the aforementioned embodiment uses a finite difference method, other numerical methods, such as finite element analysis, may also be used.

The following example shows simulation results generated by a simulator in accordance with one embodiment of the invention. The following simulation results were generated by simulating CRI in the wellbore shown in FIG. 4A. In particular, the wellbore shown in FIG. 4A has a deviation of about 50 degrees from depth of 500 m to 1800 m. The deviation angle subsequently decreases to about 30 degrees from 2062 to 2072 m. The tubing section consists of a 5½" tubing from the surface to a depth of about 1756 m, and 4½" tubing from 1756 m-2055 m. In addition, the perforations at between 2062 to 2072 m.

The cuttings slurry used in the simulation is characterized as a power-law fluid with n=0.39 and k=0.0522 lbf-sec$^n$/ft$^2$. The low shear rate viscosity for the cuttings slurry was simulated at 25,000 cP. Further, the cuttings slurry was assumed to have a maximum possible particle size of approximately 420 microns with no D90 values over 200 microns. In addition, 10% of the cuttings in slurry have a particle size of 420 microns. With respect to the operational parameters, each injection stage included 80 barrels of slurry pumped at a rate of four barrels per minute. The shut-in time between injection stages was set to 12 hours. In the simulation, ten cycles of injecting and shut-in were simulated.

Figure 4B:
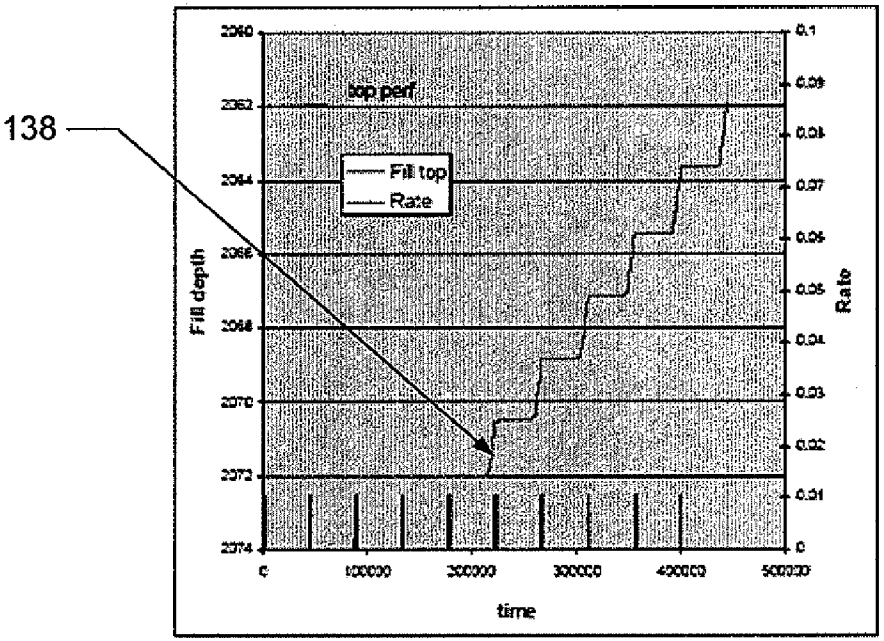
FIGS. 4A-4D show simulation results in accordance with one embodiment of the invention.
Figure 4A:
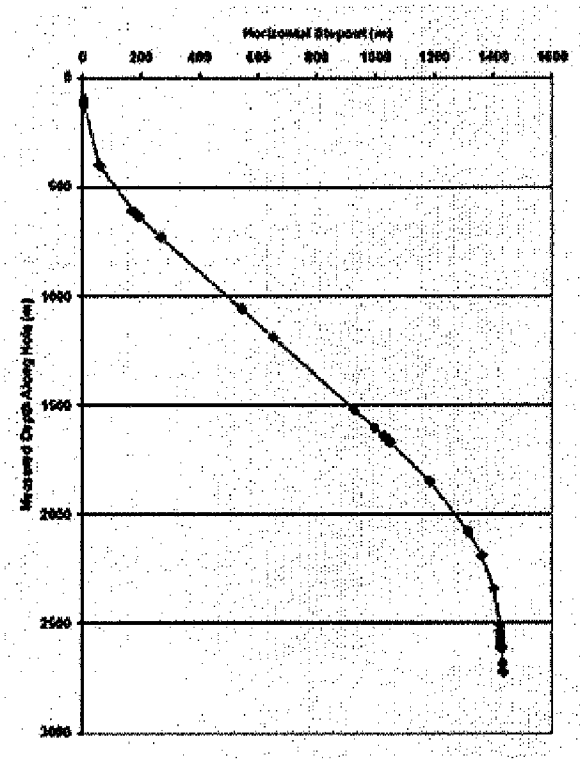

FIG. 4B shows the results of solid accumulation at the wellbore bottom through ten injections with 12 hours of shut-in time between injections. In particular, FIG. 4B shows that solids start to build up in the wellbore after five injections (denoted by reference number (138)). In this particular example, a possible cause of the solids accumulation at the bottom of the wellbore may be determined from examining the solids bed distribution in the wellbore shown in FIG. 4C.

Figure 4D:
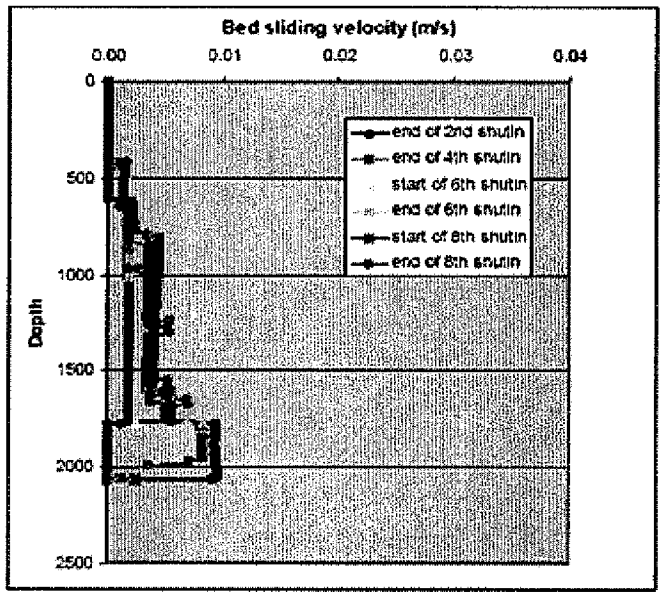
Figure 4C:
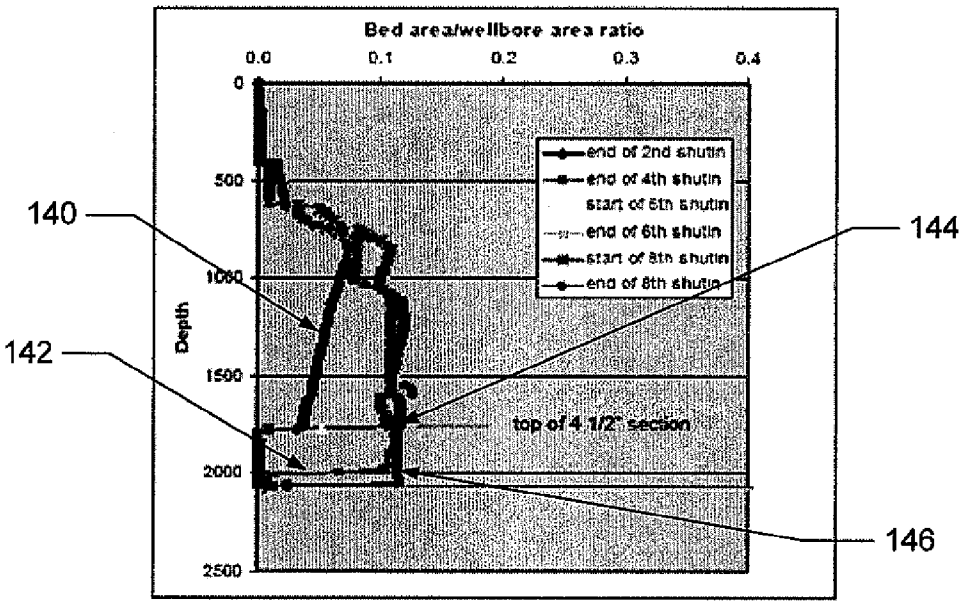

FIG. 4C shows the solids bed distribution obtained from the simulation. As shown in FIG. 4C, the solids deposit on the low side of the wellbore in the deviated section (i.e., between 500 to 1800 m), form a solids bed. The bed subsequently slides downward towards the wellbore bottom. The solids bed in the lower 4½" tubing section is again cleaned up during the injection section, while the solids bed in the 5½" section slides down into the 4½" section during the shut-in period. In the early injections (see e.g., curves labeled end of 2$^{nd}$ (140) and 4$^{th}$ (142) shut-in period in FIG. 4C), the solids bed has not accumulated sufficiently for it to reach the tubing tail, and thus there is no solids build-up at wellbore bottom. However, at the later injections (see e.g., curves labeled end of 6$^{th}$ (144) and 8$^{th}$ (146) shut-in period in FIG. 4C), the solids bed has a sufficient amount of time during the shut-in period to slide past the tubing tail into the casing section (i.e., >2055 m). The solids that slid into the casing pile up at the casing bottom and gradually plug the perforations.

FIG. 4D shows the bed sliding velocity at various times during the simulation. As shown in FIG. 4D, embodiments of the invention enable the simulator to simulate the bed sliding velocity across the entire length of the wellbore at any time throughout the simulation. Thus, based on the above simulation the user may modify an input, such as the shut-in time, and re-run the simulation to see if the rate of solid accumulation decreases.

Figure 5:
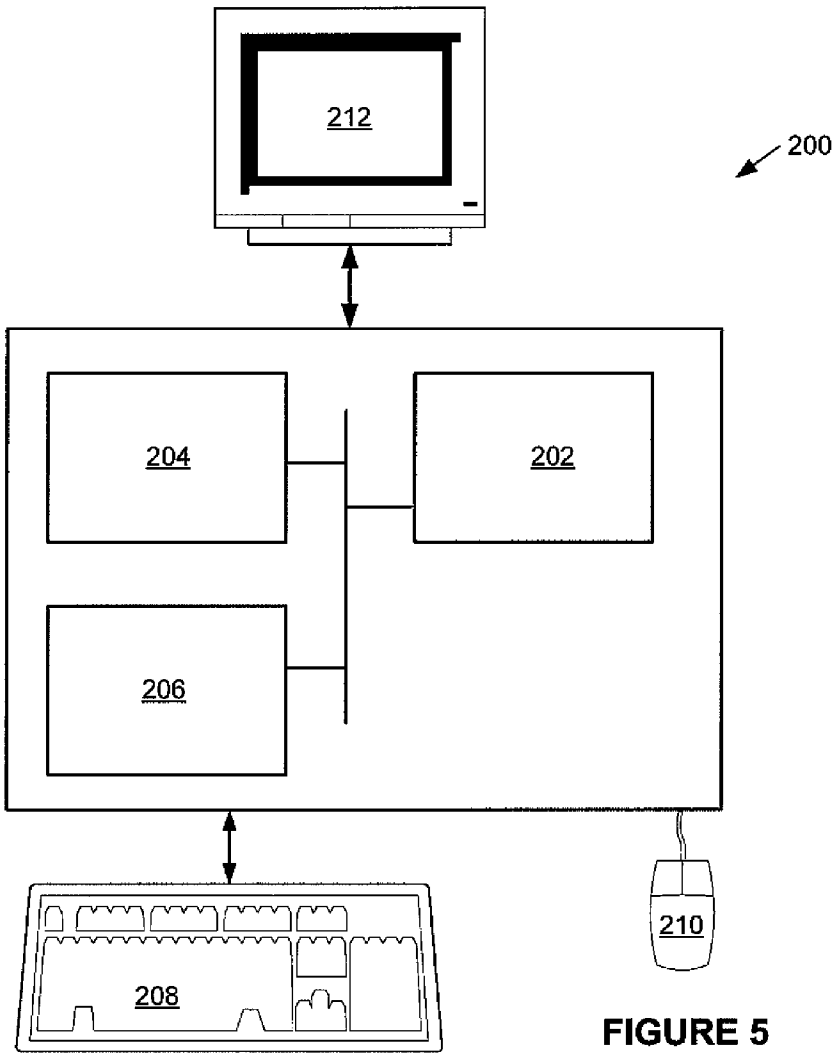
FIG. 5 shows a computer system in accordance with one embodiment of the invention.

The invention may be implemented on virtually any type of computer regardless of the platform being used. For example, as shown in FIG. 5, a computer system (200) includes a processor (202), associated memory (204), a storage device (206), and numerous other elements and functionalities typical of today's computers (not shown). The computer (200) may also include input means, such as a keyboard (208) and a mouse (210), and output means, such as a monitor (212). The computer system (200) is connected to a local area network (LAN) or a wide area network (e.g., the Internet) (not shown) via a network interface connection (not shown). Those skilled in the art will appreciate that these input and output means may take other forms.

Further, those skilled in the art will appreciate that one or more elements of the aforementioned computer system (200) may be located at a remote location and connected to the other elements over a network. Further, the invention may be implemented on a distributed system having a plurality of nodes, where each portion of the invention may be located on a different node within the distributed system. In one embodiment of the invention, the node corresponds to a computer system. Alternatively, the node may correspond to a processor with associated physical memory. Further, software instructions to perform embodiments of the invention may be stored on a computer readable medium such as a compact disc (CD), a diskette, a tape, a file, or any other computer readable storage device.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for simulating cuttings re-injection in a wellbore, comprising:

in a computer, defining a mass balance equation for a solids bed;

defining a mass balance equation for a suspension solids;

segmenting the wellbore into a plurality of elements, wherein each element comprises a plurality of nodes;

obtaining a simulation result by performing cuttings re-injection simulation by solving the mass balance equation for the solids bed and the mass balance equation for the suspension solids for each of the plurality of nodes; and storing the simulation result.

2. The method of claim 1, wherein solving comprises applying a finite difference method to iteratively solve the mass balance equation for the solids bed and the mass balance equation for the suspension solids for each of the plurality of nodes.

3. A computer readable medium comprising computer readable program code embodied therein for causing a computer system to:

define a mass balance equation for a solids bed;

define a mass balance equation for a suspension solids;

segment a wellbore into a plurality of elements, wherein each element comprises a plurality of nodes;

obtain a simulation result by performing cuttings re-injection simulation by solving the mass balance equation for the solids bed and the mass balance equation for the suspension solids for each of the plurality of nodes; and store the simulation result.

4. The computer readable medium of claim 3, further comprising computer readable program code for causing the computer system to:

input at least one wellbore design parameter for the wellbore, wherein the cuttings re-injection simulation uses the at least one wellbore design parameter.

5. The computer readable medium of claim 4, wherein the at least one wellbore design parameter comprises at least one selected from a group consisting of a wellbore depth, a wellbore diameter, a tubing property, a casing property, a depth of a top of a perforated interval in the wellbore, a depth of a bottom of a perforated interval in the wellbore, and a deviation angle of the wellbore.

6. The computer readable medium of claim 3, further comprising computer readable program code for causing the computer system to:

input at least one operating parameter for the cuttings re-injection, wherein the cuttings re-injection simulation uses the at least one operating parameter, and the slurry design.

7. The computer readable medium of claim 6, wherein the at least one operating parameter comprises at least one selected from a group consisting of a cuttings re-injection pump rate and a shut-in time.

8. The computer readable medium of claim 3, further comprising computer readable program code for causing the computer system to:

input a slurry design for a slurry to be injected into the wellbore, wherein the cuttings re-injection simulation uses the slurry design.

9. The computer readable medium of claim 8, wherein the slurry design comprises at least one selected from the group consisting of slurry rheology and size of particles in the slurry.

10. The computer readable medium of claim 3, wherein solving comprises applying a finite difference method to iteratively solve the mass balance equation for the solids bed and the mass balance equation for the suspension solids for each of the plurality of nodes.

11. The computer readable medium of claim 3, wherein the plurality of elements are of equal size.

12. A computer readable medium comprising computer readable program code embodied therein for causing a computer system to:

input at least one wellbore design parameter for a wellbore;

input at least one operating parameter for the cuttings re-injection;

input a slurry design for a slurry to be injected into the wellbore;

segment the wellbore into a plurality of elements, wherein each element comprising a plurality of nodes;

perform a simulation at a current time interval, wherein performing the simulation comprises:

updating a solid accumulation at a bottom of the wellbore at the current time interval; and performing for each of the plurality of nodes, until the wellbore reaches a steady-state condition for the current time interval, the following using the at least one wellbore design parameter, the at least one operating parameter, and the slurry design:

calculating a sliding bed velocity;

calculating a suspension cross-section area using the sliding bed velocity;

calculating an average suspension concentration using the suspension cross-section area;

calculating a solid particle velocity using the average suspension velocity; and calculating a solid volume concentration in suspension using the solid particle velocity;

obtain a simulation result after the steady-state condition is reached; and store the simulation result.

13. The computer readable medium of claim 12, further comprising computer readable program code for causing the computer system to:

determine whether the simulation result satisfies a criterion;

modify, at least one selected from a group consisting of the at least one wellbore design parameter for the wellbore, the at least one operating parameter for the cuttings re-injection, and the slurry design for a slurry to be injected into the wellbore, to obtain a modified parameter; and repeat the simulation at the current time interval using the modified parameter.

14. The computer readable medium of claim 13, wherein the criterion is the rate of solid accumulation in the wellbore.

15. The computer readable medium of claim 12, wherein the steady-state condition is determined using a nodal solids mass for each of the plurality of elements.

16. The computer readable medium of claim 15, wherein the wellbore reaches the steady-state condition when the nodal solids mass for each of the plurality of nodes converges.

17. The computer readable medium of claim 12, wherein the slurry design comprises at least one selected from the group consisting of slurry rheology and size of particles in the slurry.

18. The computer readable medium of claim 12, wherein the at least one operating parameter comprises at least one selected from the group consisting of a cuttings re-injection pump rate and a shut-in time.

19. The computer readable medium of claim 12, wherein the at least one wellbore design parameter comprises at least one selected from the group consisting of a wellbore depth, a wellbore diameter, a tubing property, a casing property, a depth of a top of a perforated interval in the wellbore, a depth of a bottom of a perforated interval in the wellbore, and a deviation angle of the wellbore.

20. The computer readable medium of claim 12, wherein the plurality of elements are of equal size.

* * * * *